US011302131B2

(12) United States Patent
Kolb et al.

(10) Patent No.: US 11,302,131 B2
(45) Date of Patent: Apr. 12, 2022

(54) PORTABLE LOCK

(71) Applicant: ABUS August Bremicker Soehne KG, Wetter-Volmarstein (DE)

(72) Inventors: Marcus Kolb, Girod (DE); Marvin Mueller, Salz (DE)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 0 days.

(21) Appl. No.: 16/408,255

(22) Filed: May 9, 2019

(65) Prior Publication Data

US 2019/0371097 A1 Dec. 5, 2019

(30) Foreign Application Priority Data

May 11, 2018 (DE) ..... 102018111301.3

(51) Int. Cl.
*G07C 9/00* (2020.01)
*G07C 9/28* (2020.01)

(52) U.S. Cl.
CPC ..... *G07C 9/28* (2020.01); *G07C 9/00309* (2013.01); *G07C 9/00571* (2013.01); *G07C 2209/62* (2013.01)

(58) Field of Classification Search
CPC ..... E05B 2047/0058; E05B 2047/0065; E05B 2047/0094; E05B 2047/0095; E05B 45/005; E05B 47/0012; E05B 47/0603; E05B 67/063; E05B 17/22; E05B 2045/063; E05B 2045/067; E05B 45/06; E05B 45/10; E05B 47/0611; E05B 47/0657; E05B 47/0673; E05B 17/002; E05B 17/0054;
(Continued)

(56) References Cited

U.S. PATENT DOCUMENTS 8,875,550 B1 11/2014 Spunt et al.
9,495,820 B1 11/2016 Li
(Continued)

FOREIGN PATENT DOCUMENTS

DE 103 36 602 A1 3/2005
DE 20 2016 002 087 U1 5/2016
(Continued)

OTHER PUBLICATIONS

German Search Report dated Feb. 11, 2019 in related German Patent Application No. 10 2018 111 301.3 (twelve pages).
(Continued)

*Primary Examiner* — Dionne Pendleton

(74) *Attorney, Agent, or Firm* — Kilpatrick Townsend & Stockton LLP

(57) ABSTRACT

The invention relates to a portable lock having an unlocking motor, an authentication module for authenticating a user of the lock by which the unlocking motor can be actuated to unlock the lock on a successful user authentication, and having a transport security element that can be actuated by the user and whose actuation moves the lock into a transport security mode in which an unlocking of the lock is precluded. A further subject matter is a locking system comprising such a lock and a mobile end device by means of which a user of the lock can authenticate himself thereat. The invention furthermore relates to a method of unlocking a mobile lock.

17 Claims, 2 Drawing Sheets

Figure 1:
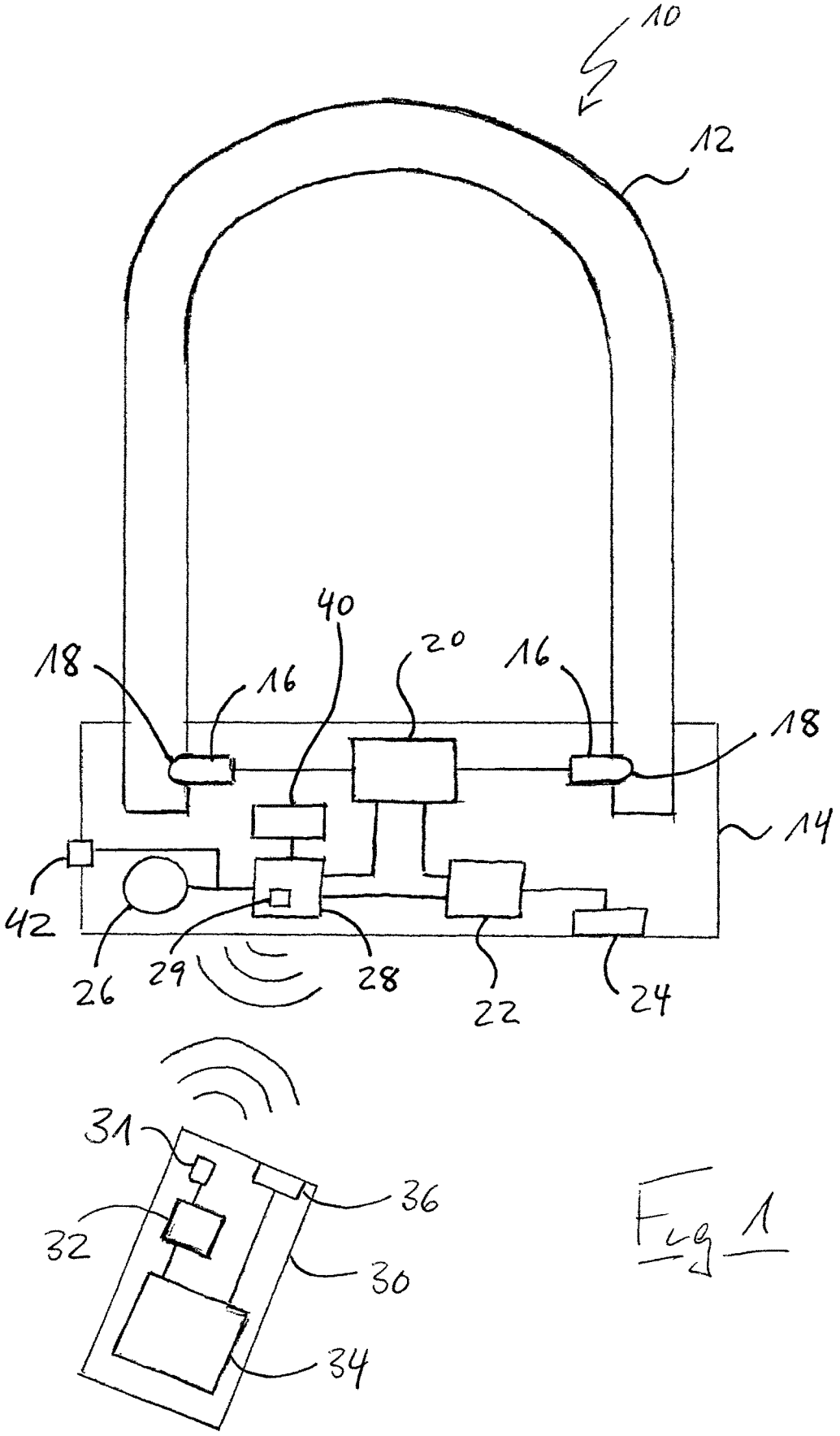

(58) Field of Classification Search
CPC .. E05B 17/2084; E05B 37/0075; E05B 37/10; E05B 63/0056; E05B 67/00; E05B 67/02; E05B 2047/0084; E05B 2047/0096; E05B 35/105; E05B 49/00; E05B 49/004; E05B 65/52; E05B 67/003; E05B 67/006; E05B 67/28; G07C 2009/00793; G07C 9/00111; G07C 9/00309; G07C 9/00571; G07C 2009/00317; G07C 2009/00769; G07C 9/00904; G07C 9/27; G07C 2209/62; G07C 2209/64; G07C 9/00; G07C 9/00896; G07C 2009/00746; G07C 2009/00825; G07C 2009/00841; G07C 9/00182; G07C 9/00817; E05Y 2900/132; G01R 31/392; G08B 13/06; G08B 13/08; G08B 13/19697; G08B 7/064; H04N 7/18; H04N 7/183
See application file for complete search history.

(56) References Cited

U.S. PATENT DOCUMENTS

2008/0024272 A1 1/2008 Fiske
2009/0167526 A1* 7/2009 Graves ..... G07C 9/00309 340/540
2011/0260867 A1 10/2011 McCracken et al.
2016/0047142 A1* 2/2016 Gengler ..... G07C 9/00571 340/5.61
2016/0343182 A1* 11/2016 Dumas ..... G07C 9/28
2018/0106871 A1* 4/2018 Kalous ..... G07C 9/00571
2018/0230713 A1* 8/2018 Sidhu ..... G07C 9/00817
2019/0093391 A1* 3/2019 Ek ..... E05B 17/22
2019/0371096 A1* 12/2019 Fisher ..... G07C 9/00571

FOREIGN PATENT DOCUMENTS

DE 20 2016 002 367 U1 5/2016
WO 2015/079203 A1 6/2015
WO 2017/079743 A1 5/2017

OTHER PUBLICATIONS

European Search Report dated Sep. 25, 2019 in related European Patent Application No. 19172283.4.

* cited by examiner

Fig. 2A
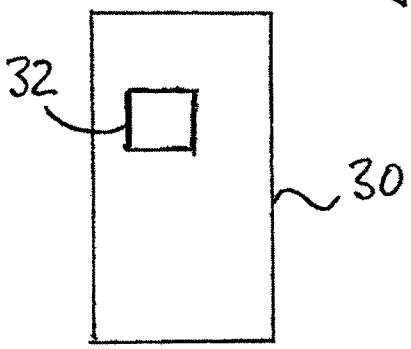
Fig. 2C
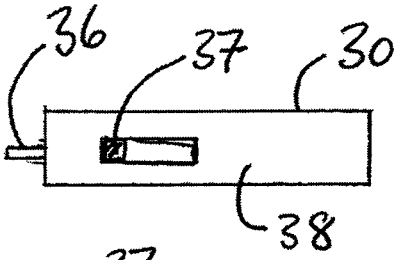
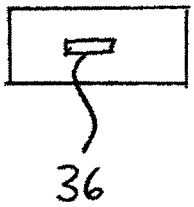
Fig. 2B
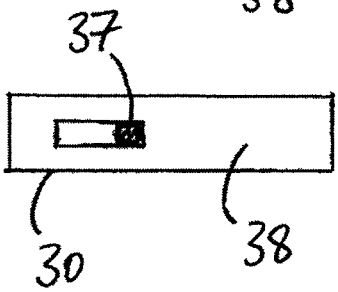
Fig. 2D

PORTABLE LOCK

This application claims priority to German Patent Application No. 102018111301.3, filed May 11, 2018, the disclosure of which is incorporated by reference herein.

The invention relates to a portable lock having an unlocking motor and an authentication module for authenticating a user of the lock by which the unlocking motor can be actuated to unlock the lock on a successful user authentication.

A portable lock is understood in this context as every kind of lock that is not installed in a stationary manner at or in a building or a motor vehicle, in particular a two-wheeler, but can rather be removed from an object to be closed such as a padlock, a hoop lock, a cable lock, or a brake disk lock.

A hoop lock having an unlocking motor and an authentication module is generally known and enables an authentication of the user that runs in the background using a mobile end device that the user carries with him and enables an electronic unlocking of the lock in the event of a successful user authentication, i.e. the user does not have to carry a matching physical key with him for this purpose and to insert it into the lock.

Due to the authentication process that runs in the background and is thus not noticed by the user, there is the possibility with the known hoop lock that the latter is unintentionally unlocked during the transport. In particular when a bike rider hangs the hoop lock on his bicycle steering wheel for transport purposes, an unintentional unlocking of the lock entails the risk of not only a loss of the lock, but also of an accident if namely the lock falling off the bicycle handlebars or at least parts thereof falls/fall into the spokes of the bicycle.

It is the underlying object of the invention to make the use of a portable lock safer.

A portable lock having the features of claim 1 is provided to satisfy this object.

The portable lock in accordance with the invention comprises an unlocking motor, an authentication module for authenticating a user of the lock by which the unlocking motor can be actuated to unlock the lock on a successful user authentication, and a transport security element that can be actuated by the user and whose actuation moves the lock into a transport security mode in which an unlocking of the lock is precluded.

In other words, the invention is based on the underlying idea of providing the user with the possibility via the transport security element of deliberately excluding an unintentional unlocking of the lock during the transport. Even if the user therefore doe not only carry the lock with him, but also a mobile end device required for the authentication, it is ensured by the transport security module that the lock cannot accidentally unlock. The risk of a loss of the lock or of an accident arising from an involuntary unlocking of the lock is considerably reduced in this manner.

Advantageous embodiments of the invention can be seen from the dependent claims, from the description and from the drawing.

An unintentional unlocking of the lock in the transport security mode can be prevented in a particularly effective manner in that the carrying out of a user authentication is precluded as long as the lock is in the transport security mode. The user authentication is in other words suppressed in the transport security mode, that is the authentication module is so-to-say set to passive. Since the authentication module that is set to passive cannot carry out any authentication procedures, it does not consume any energy or at least any significant energy. The energy supply of the lock, for example a battery respectively a rechargeable battery of the lock is additionally conserved with a lock in the transport security mode in this manner and the risk is minimized that the lock can no longer be actuated due to a battery respectively a rechargeable battery that has become flat. It is recommended to this extent not only to switch the transport security mode on during a transport of the lock, but also during a longer non-use of the lock, for example during an absence of the user due to vacation or during a storage of the lock or of a two-wheeler secured thereby due to bad weather.

The lock is preferably movable from the transport security mode back into a normal mode by actuating the transport security element, in which normal mode the unlocking motor can be actuated to unlock the lock on a successful user authentication. A separate element for the resetting of the lock into the normal mode is therefore not necessary, but the lock can rather be switched to and fro between the normal mode and the transport security mode by consecutive actuation of the transport security element.

The transport security element is preferably an impulse generator, in particular a button, for example a push button or a slider button. It is, however, also conceivable to form the transport security element by an optically acting, capacitively acting, or inductively acting control surface.

In accordance with an embodiment, the transport security element is formed at the lock. This enables a particularly simple and intuitive operation of the lock without the user having to take his mobile end device into his hand for this purpose and connecting it to the lock.

Alternatively or additionally, however, it is also conceivable to provide a transport security element at the mobile end device so that the user can switch to and fro between the normal mode and the transport security mode of the lock via his mobile end device.

To be able to carry out the authentication of the user unnoticed by the user in the background with a lock in the normal mode, the authentication preferably takes place wirelessly. The user therefore does not need to separately take out a mobile end device enabling the authentication that he carries with him for the authentication such as a remote control, a smartphone, or a smart watch for authentication purposes, but can rather leave it in his pocket.

The authentication module advantageously comprises a transceiver to establish a wireless connection to a mobile end device of the user. The mobile end device can be a remote control associated with the lock or also a portable computer which the user normally anyway carries with him, for example a smartphone, a smart watch, or a tablet.

The wireless connection is preferably a Bluetooth connection. Bluetooth connections have in particular proven themselves with respect to range and universality.

In accordance with a further embodiment, the lock has an actuation element that can be actuated by the user and by means of which the unlocking motor can be activated to unlock the lock on a successful user authentication. As already mentioned, the authentication of the user takes place unnoticed by the user in the background with a lock in the normal mode. To prevent an unintentional unlocking of the lock on a successful authentication of the user, for example when the user is located within a distance from the lock enabling the authentication, but he does not intend to unlock the lock, the user therefore has to carry out a conscious action in the case of an actually desired unlocking of the lock in that he actuates the actuation element.

The wireless authentication makes it possible for the user generally already to be able to be authenticated on an approach toward the lock with the lock in the normal mode so that the unlocking motor can be actuated without a time delay on an actuation of the actuation element, which contributes to an increased comfort in use. It is understood that for such an early authentication of the user, the authentication module always has to be kept in an alert state in which it for its part transmits signals for the detection of users possibly present in the vicinity and/or can respond to identification queries of users present in the vicinity.

An embodiment is therefore preferred in which the authentication module can be actuated by actuating the actuation element. In this case, the authentication module therefore only consumes energy when it is actually activated, whereby an energy supply of the lock is conserved. The authentication module is only woken up so-to-say by actuation of the actuation element to perform a pairing with a mobile end device of the user that may be present in the vicinity and to carry out an authentication process. Depending on how fast the waking up of the authentication module, the pairing of the authentication module and the mobile end device, and the actual authentication take place, the lock is only unlocked with a certain time delay after actuating the actuation element in this case.

In accordance with a particularly preferred embodiment, the actuation element is formed by a motion sensor for detecting a movement of the lock arranged in the lock and connected to the authentication module. In this case, the user has to actively move the lock to trigger the authentication procedure or the activation of the unlocking motor. As already mentioned, the triggering of the authentication procedure is suppressed when the lock is in its transport security mode. This can take place, for example, in that the sensor is not read as long as the lock is in its transport security mode.

Alternatively, the actuation element can also be formed by an impulse generator, in particular a button, preferably a push button or a slider button, and/or by an optically acting, capacitively acting, or inductively acting control. It is additionally conceivable to provide an actuation element at the mobile end device of the user.

In accordance with an even further embodiment, the lock comprises an alarm module that is connected to the motion sensor and to the authentication module and that outputs an alarm, in particular an acoustic alarm, in the event of a movement of the lock detected by the sensor and of an unsuccessful user authentication. Theft protection is substantially increased by such an alarm function. If the motion sensor is not read with a lock in the transport security mode, the alarm function is also deactivated in the transport security mode.

The unlocking motor is preferably an electric motor. It is understood that the portable lock preferably has an energy store for supplying the unlocking motor, the authentication module, and optionally the actuation element with energy. The energy store can thus, for example, be a battery respectively a rechargeable battery.

It is further understood that not only the unlocking of the lock is possible on a successful user authentication and actuation of the actuation element, but also a locking of the lock is conceivable in the same manner.

A further subject matter of the invention is a locking system having a portable lock of the above-described kind and having a mobile end device by means of which a user of the lock can be authenticated thereat. The advantages named above in connection with the portable lock apply accordingly to the locking system in accordance with the invention.

So that the mobile end device can communicate with the authentication module of the lock, the mobile end device advantageously also comprises a transceiver to establish a wireless connection to the authentication module of the lock.

As already mentioned, the mobile end device can be a remote control or a portable computer, in particular a smart watch, a smartphone, a tablet, etc.

In accordance with an embodiment, the portable end device has an energy store by which the lock can at least be supplied with sufficient energy for an emergency unlocking. The lock can then also still be unlocked in this manner if it is itself fully without current or voltage, for example because a battery of the lock is defective or because the user has forgotten to charge a rechargeable battery of the lock in time. The energy store of the mobile end device in other words ensures an emergency power supply/emergency voltage supply.

To implement such an emergency power/voltage supply, the lock and the mobile end device preferably have complementary connection elements by means of which the mobile end device can be connected to the lock to supply the lock with energy.

The connection elements can, for example, comprise a USB plug and a USB socket.

In particular when the mobile end device is a remote control associated with the lock, the connection element of the mobile end device can be movable between a passive position in which it is protected in a housing of the mobile end device and an active position in which it at least partly projects out of the housing and is couplable to the connection element of the lock.

A further subject matter of the invention is a method of unlocking a mobile lock that has an unlocking motor, an authentication module, and a transport security actuable by the user, in which method the authentication module carries out an authentication of the user in a normal state of the lock, the authentication module actives the unlocking motor to unlock the lock on a successful user authentication, and the lock is moved into a transport security mode in which an unlocking of the lock is precluded by actuating the transport security element. The aforesaid advantages can be achieved accordingly by the method in accordance with the invention.

The unlocking of the lock in the transport security mode can be particularly effectively precluded when the carrying out of a user authentication is prevented as long as the lock is in the transport security mode. The user authentication is in other words suppressed in the transport security mode, that is the authentication module is so-to-say set to passive.

As already mentioned, the lock is moved from the transport security mode back into the normal mode by actuating the transport security element, in which normal mode the unlocking motor can be actuated to unlock the lock on a successful user authentication.

The authentication module can furthermore be activated by a movement of the lock detected by means of a motion sensor with a lock in the normal mode. The authentication module can therefore also move into an energy-saving passive state in the normal mode and can be woken up again by moving the lock to carry out an authentication process.

If the authentication module is actuated with a lock in the normal mode in the event of a movement of the lock detected by a motion senor and if a resulting user authentication does not run successfully, an alarm, in particular an acoustic alarm, can be output.

The invention will be described in the following purely by way of example with reference to possible embodiments and to the enclosed drawing. There are shown:

FIG. 1 a schematic representation of a locking system in accordance with a first embodiment of the invention;

FIG. 2A a plan view of a remote control of the locking system of FIG. 1;

FIG. 2B a front view of the remote control of FIG. 2A;

FIG. 2C a side view of the remote control of FIG. 2A with an extended connector element;

FIG. 2D a side view of the remote control of FIG. 2A with a retracted connector element;

The locking system shown in FIG. 1 comprises a portable lock 10 in the form of a hoop lock comprising a U-shaped closing hoop 12 whose ends are received in a lock body 14 and locked therein in a locked state of the lock 10.

The locking of the closing hoop 12 in the lock body 14 takes place by means of locking elements 16 that are movably supported in the lock body 14, that engage in corresponding locking recesses 18 of the closing hoop 12, and thereby prevent the closing hoop 12 from being able to be pulled out of the lock body 14.

To unlock the lock 10, the locking elements 16 can be released, for example against the return force of locking springs that are not shown and that preload the locking elements in the direction of the locking recesses 18, from the locking recesses 18 by means of an unlocking motor 20, here in the form of an electric motor, that is arranged in the lock body 14.

Since the locking of the closing hoop 12 in the lock body 14 is effected by the locking springs that displace the locking elements 16 into the locking recesses 18 and since the unlocking motor 20 ultimately only provides the unlocking of the lock 10, the lock 10 is also called a semi-automatic lock 10. A fully automatic lock 10 is, however, generally also conceivable in which the unlocking motor 20 provides both the unlocking and the locking.

An energy store 22 is accommodated in the lock body 14 for the energy supply of the unlocking motor 20. In the present embodiment, the energy store 22 is a rechargeable battery that can be charged by means of a connection element, here in the form of a USB socket, that is accessible from the outside. Alternatively, however, the energy store 22 could also be a battery that can be replaced as required.

To trigger an unlocking procedure, an actuation element 26, here in the form of a motion sensor, is accommodated in the lock body 14. The actuation of the actuation element 26 in this case therefore takes place by a movement of the lock 10. Alternatively, the actuation element 26 could, however, also be an optically acting or inductively acting control or a button, in particular a push button or a slider switch.

The actuation element 26 is connected to an authentication module 28 that is accommodated in the lock body 14 and that is in turn connected to the unlocking motor 20. If the lock 10 is in a normal mode, the authentication module 28 is activated by actuating the actuation element 26, i.e. therefore by the detection of a movement of the lock 10 and the authentication module 28 carries out an authentication procedure. For this purpose, the authentication module 28 first establishes a Bluetooth connection by means of a transceiver 29 to a mobile end device 30 that a user of the lock 10 carries with him for this purpose.

In the present embodiment, the mobile end device 30 is a Bluetooth enabled remote control (see also FIG. 2) that in turn has a transceiver 31 and that can be switched on by means of a switch-on element 32. The remote control can also have a motion sensor, not shown, for example a 3D positional sensor, for detecting a movement of the remote control that makes it possible to wake up the remote control on detection of a movement after it has changed into an energy-saving passive state after its use.

Alternatively, the mobile end device 30 can be formed by a smart watch, a smartphone, or another Bluetooth enabled portable computer.

As soon as the authentication module 28 has established a Bluetooth connection to the mobile end device 30, it carries out an authentication of the mobile end device 30. In the event of a positive authentication, the authentication module 28 transmits a release signal to the unlocking motor 20 so that it can move the locking elements 16 and the closing hoop 12 out of engagement for the unlocking of the lock 10.

If, in contrast, the mobile end device 30 is not positively authenticated, the authentication module 28 does not transmit any release signal to the unlocking motor 20, i.e. the lock 10 is not unlocked and can thus not be opened by the user. The authentication module 28 instead causes an alarm module 40 connected to the authentication module 28 to output an alarm, in particular an acoustic alarm.

To protect against an unintentional unlocking of the lock 10, the lock 10 additionally has a transport security element 42 that can be actuated by the user and with whose aid the user can move the lock 10 into a transport security mode.

In the present embodiment, the transport security element 42 is a slider button formed at a suitable point of the lock body 14 and accessible from the outside. Other kinds of impulse generators can, however, generally also be considered such as push buttons or optically acting, capacitively acting, or inductively acting controls.

By an actuation of the transport security element 42, the lock can be moved out of the above-described normal mode into a transport security mode in which the motion sensor 26 is not read. The motion sensor 26 is so-to-say therefore moved to passive. This in turn means that neither the authentication module 28 nor the alarm module 40 can receive actuation signals. Accordingly, neither an authentication procedure required for the unlocking of the lock 10 can be carried out nor can an alarm be output. Apart from the fact that an unintentional unlocking of the lock 10 is precluded in this manner, the energy store 22 is also at most minimally loaded with a lock 10 in the transport security mode.

A switchover of the lock 10 from the transport security mode into the normal mode likewise takes place by an actuation of the transport security element 42, i.e. the lock 10 can be switched to and fro between the normal mode and the transport security mode by a consecutive actuation of the transport security element 42.

It is understood that both the authentication procedure and the actual unlocking procedure require that the energy store 22 has sufficient energy. For the case that the energy store 22 is so discharged that an authentication and/or an unlocking is no longer possible, the mobile end device 30 configured as a remote control has an emergency energy store 34, for example in the form of a power bank, and a connector element 36, here in the form of a USB plug, complementary to the connector element 24 of the lock 10 to connect the emergency energy store 34 of the mobile end device 30 to the connector element 24 of the lock 10 and to charge the energy store 22 of the lock 10 at least so much that the authentication can be carried out and the lock 10 can be unlocked.

To protect the connector element 36 of the mobile end device 30 from contamination and/or damage, the connector element 36 can be retracted by a slider 37 into a housing 38 of the mobile end device 30 (FIG. 2D) and can be extended out of it again as required (FIG. 2C).

REFERENCE NUMERAL LIST

10 lock
12 closing hoop
14 lock body
16 locking element
18 locking recess
20 unlocking motor
22 energy store
24 connector element
26 actuation element
28 authentication module
29 transceiver
30 mobile end device
31 transceiver
32 switch-on element
34 emergency energy store
36 connector element
37 slider
38 housing
40 alarm module
42 transport security element

The invention claimed is:

1. A portable lock comprising:
a lock body;
an unlocking motor positioned within the lock body;
an authentication module configured for receiving a wireless authentication signal to authenticate a user of the lock;
a transport security element comprising a user actuatable device coupled to the lock body and accessible for manual actuation by the user from outside of the lock body, wherein the transport security element is configured to be actuated by the user and wherein upon an actuation by the user, the transport security element switches the lock from a normal mode into a transport security mode, wherein authentication of the user is precluded as long as the lock is in the transport security mode; and
an actuation element configured to be actuated by the user;
wherein, with the lock in the normal mode and with the user authenticated, the actuation element is configured so that actuating the actuation element by the user causes the unlocking motor to unlock the lock; and
wherein, with the lock in the transport security mode, the actuation element is configured so that actuating the actuation element by the user does not cause an actuation of the unlocking motor to unlock the lock.

2. The lock in accordance with claim 1, wherein the lock is movable from the transport security mode back into a normal mode by actuating the transport security element, and wherein while in the normal mode the unlocking motor can be actuated to unlock the lock on a successful user authentication.

3. The lock in accordance with claim 1, wherein the transport security element is an impulse generator.

4. The lock in accordance with claim 1, wherein the transport security element is formed by an optically acting, capacitively acting, or inductively acting control surface.

5. The lock in accordance with claim 1, wherein the authentication module comprises a transceiver configured for receiving the wireless authentication signal from a mobile end device of the user.

6. The lock in accordance with claim 5, wherein the wireless authentication signal is a Bluetooth signal.

7. The lock in accordance with claim 1, wherein the authentication module is actuable by actuating the actuation element.

8. The lock in accordance with claim 1,
wherein the actuation element is formed by a motion sensor coupled to the lock body and connected to the authentication module for detecting a movement of the lock.

9. The lock in accordance with claim 8, further comprising an alarm in electronic communication with the motion sensor and with the authentication module and configured to output an alarm in the event of a movement of the lock detected by the motion sensor and of an unsuccessful user authentication.

10. A portable lock comprising:
a lock body;
an unlocking motor positioned within the lock body;
an authentication module configured for receiving a wireless authentication signal to authenticate a user of the lock;
a transport security element comprising a user actuatable device coupled to the lock body and accessible for manual actuation by the user from outside of the lock body, wherein the transport security element is configured to be actuated by the user and wherein upon an actuation by the user, the transport security element switches the lock from a normal mode into a transport security mode; and
an actuation element formed by a motion sensor coupled to the lock body and connected to the authentication module for detecting a movement of the lock, the actuation element configured to be actuated by the user;
wherein, with the lock in the normal mode and with the user authenticated, the actuation element is configured so that actuating the actuation element by the user causes the unlocking motor to unlock the lock; and
wherein, with the lock in the transport security mode, a reading of the motion sensor is blocked, and wherein, with the lock in the transport security mode, the actuation element is configured so that actuating the actuation element by the user does not cause an actuation of the unlocking motor to unlock the lock.

11. The lock in accordance with claim 10, wherein the lock is movable from the transport security mode back into a normal mode by actuating the transport security element, and wherein while in the normal mode the unlocking motor can be actuated to unlock the lock on a successful user authentication.

12. The lock in accordance with claim 10, wherein the transport security element is an impulse generator.

13. The lock in accordance with claim 10, wherein the transport security element is formed by an optically acting, capacitively acting, or inductively acting control surface.

14. The lock in accordance with claim 10, wherein the authentication module comprises a transceiver configured for receiving the wireless authentication signal from a mobile end device of the user.

15. A method of unlocking a portable lock, the portable lock comprising a lock body, an unlocking motor positioned within the lock body, an authentication module configured for receiving a wireless authentication signal to authenticate a user of the lock, a transport security element, comprising a user actuatable device formed at the lock and accessible for manual actuation by the user from the outside of the lock body, wherein the transport security element is configured to be actuated by the user and wherein upon an actuation by the user, the transport security element switches the lock from a normal mode into a transport security mode, and an actuation element configured to be actuated by the user, the method comprising:

receiving, by the authentication module, a wireless authentication signal from the user, wherein receiving the wireless authentication signal is prevented as long as the lock is in the transport security mode;

wirelessly authenticating, by the authentication module, the user based on the received wireless authentication signal; and receiving an actuation event by the user through the actuation element, wherein in response to receiving the actuation event with the lock in the normal mode, actuating the unlocking motor to unlock the lock on a successful user authentication with the authentication module, and wherein in response to receiving the actuation event with the lock in the transport security mode precluding actuation of the unlocking motor.

16. The method in accordance with claim 15, wherein the lock is moved from the transport security mode back into a normal mode by actuating the transport security element, in which normal mode the unlocking motor can be actuated to unlock the lock on a successful user authentication.

17. The method in accordance with claim 15, wherein the wireless authentication signal from the user is received from a mobile end device comprising a transceiver to establish a wireless connection to the authentication module of the lock.

* * * * *